United States Patent [19]

Kolar

[11] 4,285,147

[45] Aug. 25, 1981

[54] UNIVERSAL APPARATUS FOR EVALUATING CALENDAR DATA

[75] Inventor: Karel Kolár, Praha, Czechoslovakia

[73] Assignee: Racionalizacni a experimentalni laborator, Praha, Czechoslovakia

[21] Appl. No.: 96,057

[22] Filed: Nov. 20, 1979

[30] Foreign Application Priority Data

Nov. 20, 1978 [CS] Czechoslovakia ..... 7554/78

[51] Int. Cl.[3] ..... G09D 03/04

[52] U.S. Cl. ..... 40/109; 40/107

[58] Field of Search ..... 40/109, 107, 113, 115, 40/111, 110

[56] References Cited

U.S. PATENT DOCUMENTS

| | | | |
|---|---|---|---|
| 449,543 | 3/1891 | Kelly | 40/109 |
| 641,433 | 1/1900 | Buell | 40/109 |
| 1,493,378 | 5/1924 | Patterson | 40/109 |
| 1,611,538 | 12/1926 | Landman | 40/109 |
| 2,755,581 | 7/1956 | Johnson | 40/111 |

FOREIGN PATENT DOCUMENTS

| | | | |
|---|---|---|---|
| 2061399 | 6/1971 | Fed. Rep. of Germany | 40/109 |
| 381488 | 11/1907 | France | 40/109 |
| 1222556 | 2/1971 | United Kingdom | 40/109 |

*Primary Examiner*—Gene Mancene
*Assistant Examiner*—Michael J. Foycik

[57] ABSTRACT

The apparatus according to the invention maintains traditional calendar sequences and provides an intelligible adjustment and reading of data from any point of view and in any range of years. It also makes it possible to read data simultaneously in two calendar systems. The apparatus consists of two mutually movable members which are provided with indication members for individual calendar data. Their mutual position is set up according to a code marking of the actually desired month.

4 Claims, 15 Drawing Figures

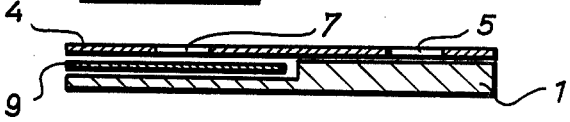
FIG-2
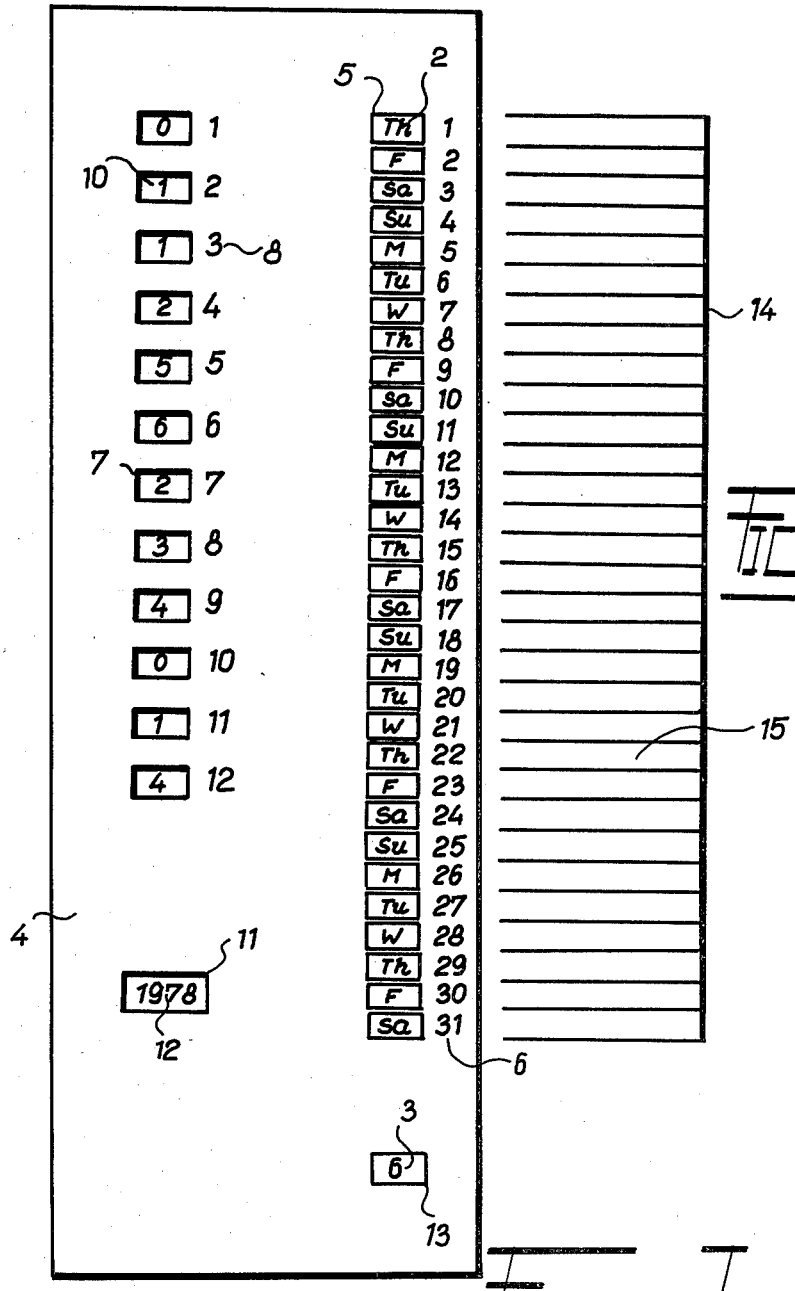
FIG-3
FIG-1

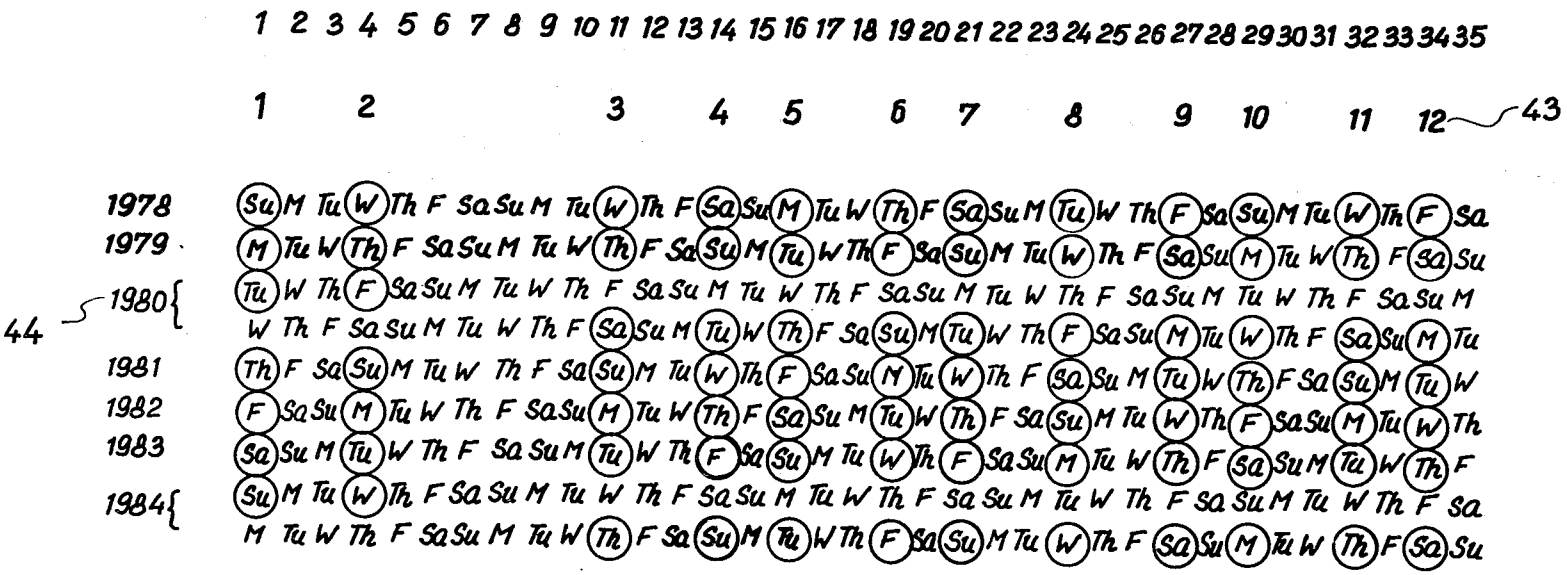
1 2 3 4 5 6 7 8 9 10 11 12 13 14 15 16 17 18 19 20 21 22 23 24 25 26 27 28 29 30 31 32 33 34 35
1 2 3 4 5 6 7 8 9 10 11 12
43
1978
1979
1980
1981
1982
1983
1984
44
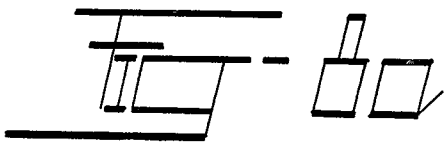

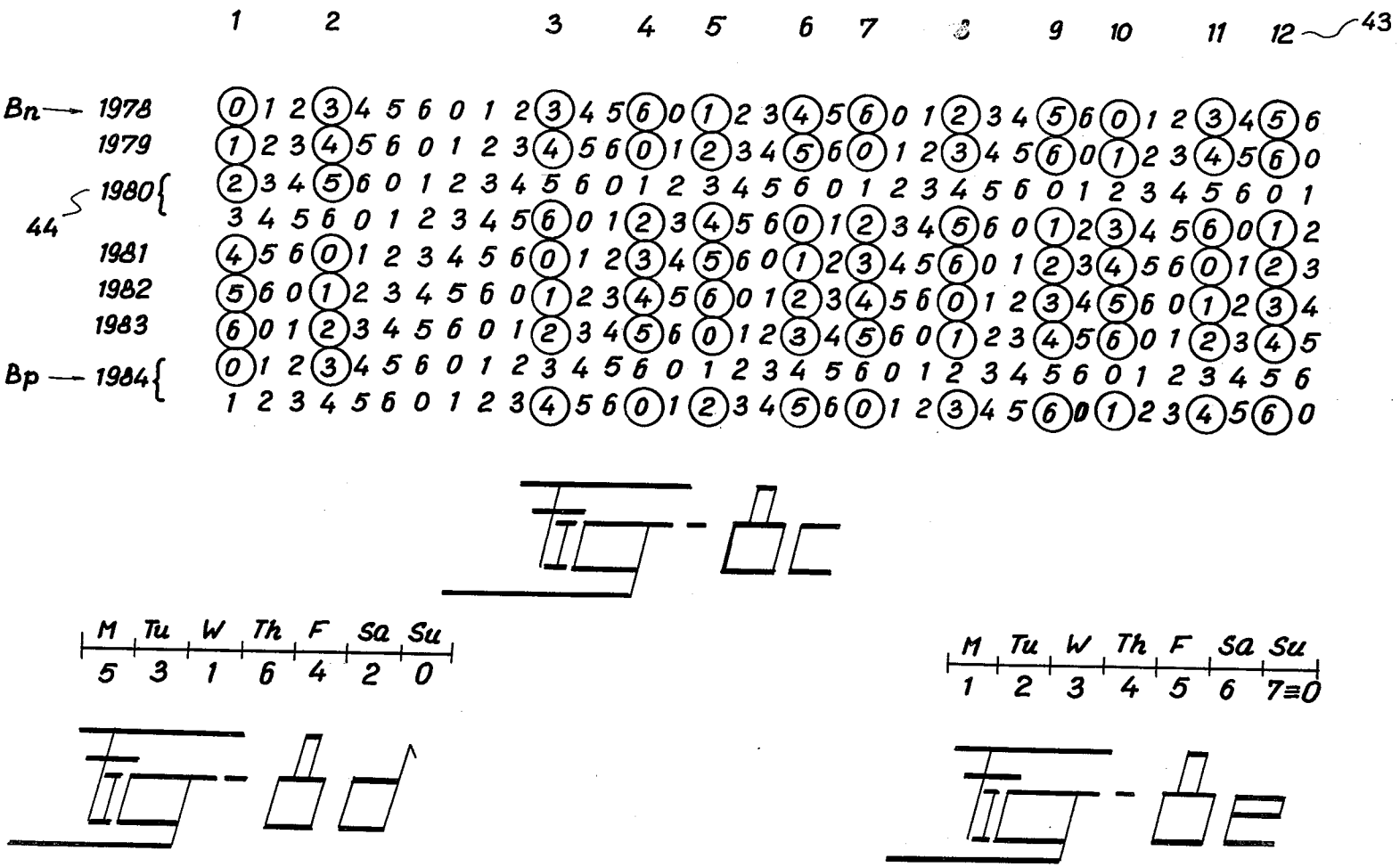
43
1 2 3 4 5 6 7 8 9 10 11 12
Bn 1978
1979
1980
44
1981
1982
1983
Bp 1984
M Tu W Th F Sa Su
5 3 1 6 4 2 0
M Tu W Th F Sa Su
1 2 3 4 5 6 7=0

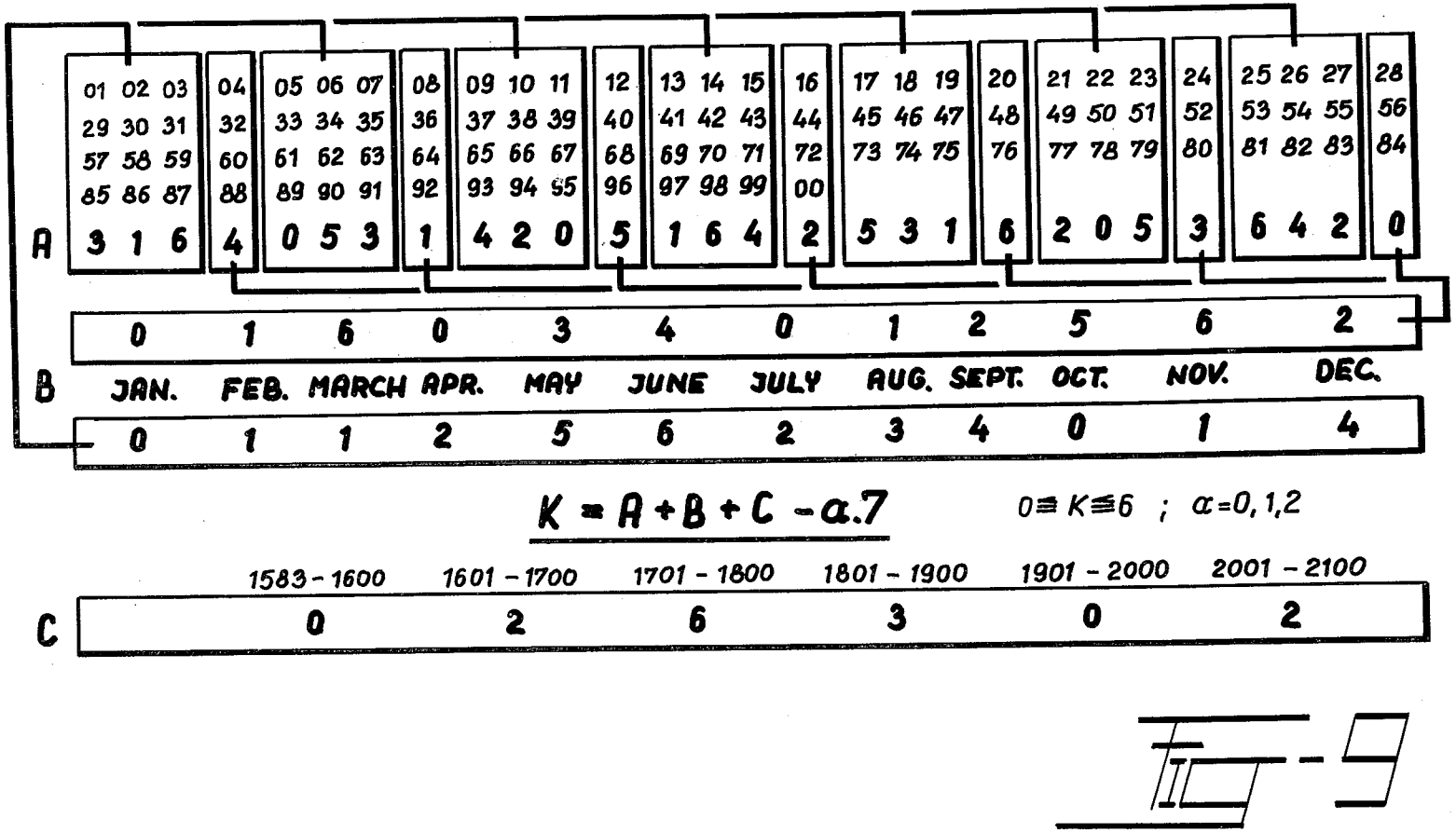
A
01 02 03
29 30 31
57 58 59
85 86 87
3 1 6
04
32
60
88
4
05 06 07
33 34 35
61 62 63
89 90 91
0 5 3
08
36
64
92
1
09 10 11
37 38 39
65 66 67
93 94 55
4 2 0
12
40
68
96
5
13 14 15
41 42 43
69 70 71
97 98 99
1 6 4
16
44
72
00
2
17 18 19
45 46 47
73 74 75
5 3 1
20
48
76
6
21 22 23
49 50 51
77 78 79
2 0 5
24
52
80
3
25 26 27
53 54 55
81 82 83
6 4 2
28
56
84
0
B
0 1 6 0 3 4 0 1 2 5 6 2
JAN. FEB. MARCH APR. MAY JUNE JULY AUG. SEPT. OCT. NOV. DEC.
0 1 1 2 5 6 2 3 4 0 1 4
K = A + B + C − α.7
0 ≦ K ≦ 6 ; α = 0, 1, 2
C
1583 - 1600
0
1601 - 1700
2
1701 - 1800
6
1801 - 1900
3
1901 - 2000
0
2001 - 2100
2

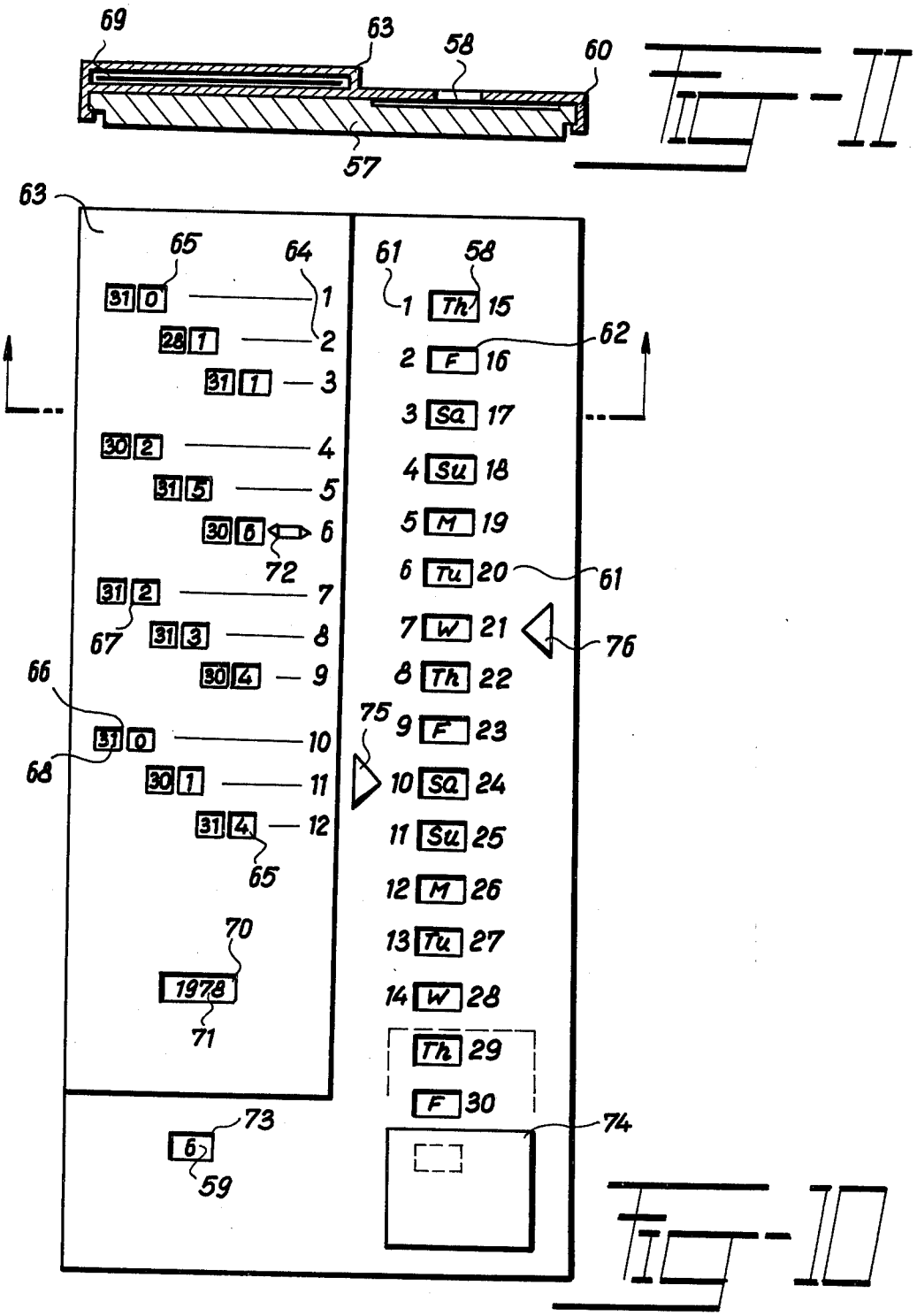
69
63
58
60
57
63
65
64
61
58
31 0
1
28 1
2
31 1
3
30 2
4
31 5
5
30 6
6
72
31 2
7
67
31 3
8
30 4
9
66
31 0
10
68
30 1
11
31 4
12
65
70
1978
71
73
6
59
1 Th 15
2 F 16
62
3 Sa 17
4 Su 18
5 M 19
6 Tu 20
61
7 W 21
76
8 Th 22
75
9 F 23
10 Sa 24
11 Su 25
12 M 26
13 Tu 27
14 W 28
Th 29
F 30
74

UNIVERSAL APPARATUS FOR EVALUATING CALENDAR DATA

This application is related to applicant's co-assigned U.S. patent application Ser. No. 95,998 filed contemporaneously herewith.

This invention relates to an universal apparatus for evaluating calendar data.

Names of the first days of calendar months change every year. This makes it necessary to issue a new printed calendar for every year. It has been attempted to provide a mechanical apparatus applicable for several years, but the results, usually a combination of tabular data, is difficult to read, and sequences of calendar data are confused in meaning. This prevents an easy survey and the application of such prior apparatus is rather limited.

The above disadvantages are obviated by the apparatus according to the invention. Such apparatus maintains traditional calendar sequences, makes possible a quick and absolute correct adjustment, and provides an easy survey and intelligible reading of data from any point of view.

In accordance with the invention there are employed two mutually movable members, the first of which is a main body provided on the reading surface thereof with a scale of names of days and with a scale of seven members that indicate the calendar code. The names of the days are M, Tu, W, Th, F, Sa, Su. The sequence of numbers of the calendar code is 5, 3, 1, 6, 4, 2, 0. The second movable member is provided both with view slits, at which there are members of a scale of digital calendar data, and with a slit, for reading the calendar code, as well as with an indication mechanism for indicating actual months consisting of view slits at which there are arranged members of a scale of calendar months, a view slit for reading the actual years, a movable plate carrying code digits of actual months, and a scale of years.

The expression of names of the first days of months by means of a code digit make possible a very quick adjustment of a calendar to a desired month in any range of years, and it represents a basic principle of the apparatus. Such apparatus is more intelligible and universal than the hitherto known solutions of the problem. A new effect resides in the fact that this apparatus can evaluate calendar data simultaneously in two or several calendar systems, and in this way it may be used as means for setting forth a new calendar system.

In order that the invention may be clearly understood and readily practiced, a preferred embodiment thereof applying linear scales is, by way of example, hereinafter more fully described and illustrated in the accompanying drawings in which:

FIG. 1 is a view in plan of a universal apparatus in accordance with the invention for evaluation calendar data;

FIG. 2 is a view in transverse section through the apparatus of FIG. 1;

FIG. 3 is a schematic view in plan of a set of shelves for an operative selection of information on free cards according to calendar date;

FIG. 6 is a fragmentary view in plan of an alternative arrangement of the system of carriers shown in FIG. 4, the embodiment of FIG. 6 having a regular distance between the scale members of calendar months;

Figures 4, 5:
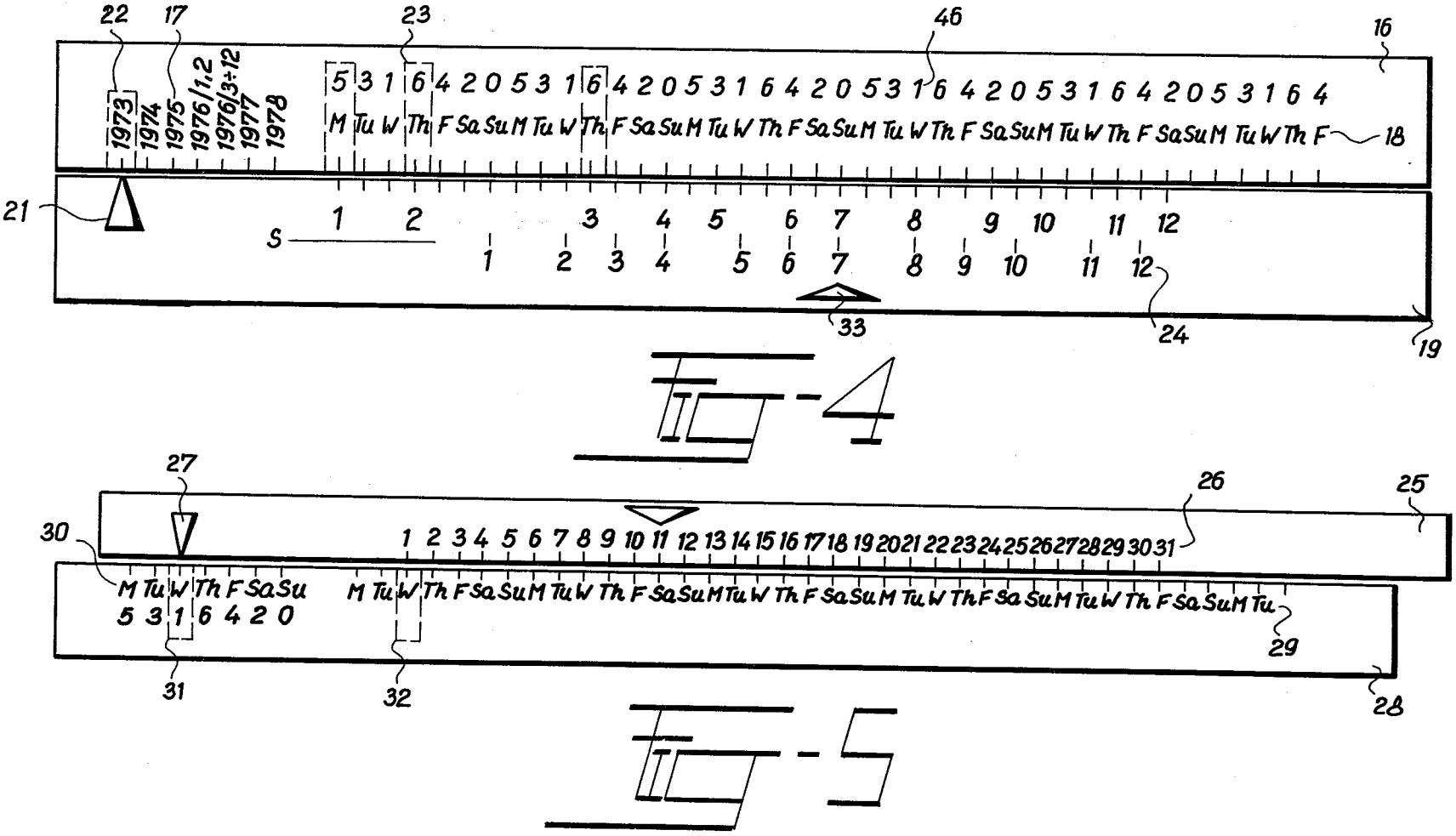
FIG. 4 is a view in plan of a first basic arrangement of scale carriers.
FIG. 5 is a view in plan of a second basic arrangement of scale carriers.
Figure 5:
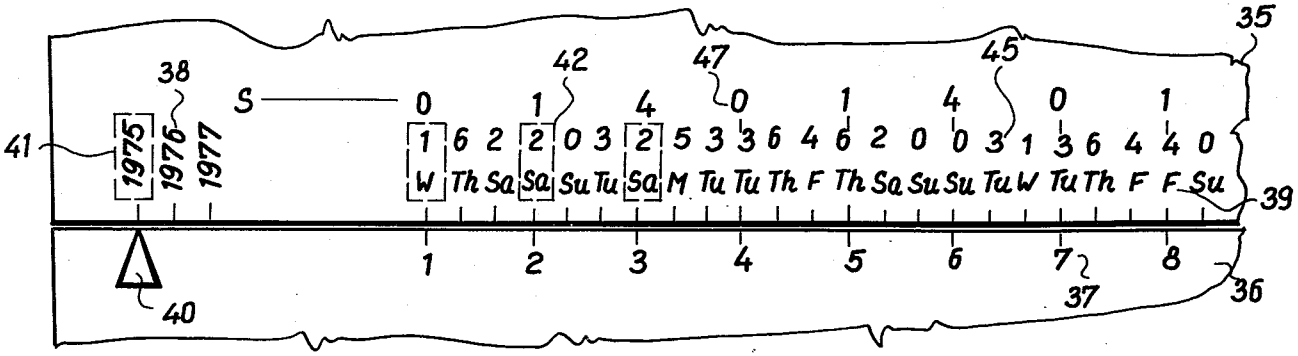

FIG. 8*a* shows members of an auxiliary scale of names of the first days of months marked by letters;

FIG. 8*b* shows members of an auxiliary scale of names of the first days of months marked by digits according to a calendar code which is shown in FIG. 8*d;*

FIG. 8*c* shows members of an auxiliary scale of names of months marked by digits according to a calendar code which is shown in FIG. 8*e;*

FIG. 9 shows an example of a tubular expression of a code marking of a month for the whole range of the calendar system;

FIG. 10 is a view in plan of a further preferred embodiment of the device of the invention; and FIG. 11 is a view in transverse section through the device of FIG. 10.

As is evident in FIGS. 1 and 2, the apparatus there shown consists of a main body 1, in the left part of which there is a cut-out for a plate 9. On the upper surface of the main body there is a scale 2 of a cyclically repeating of names of days and a scale 3 of a calendar code. Over the main body 1 there is a shiftable cover 4 in which view slits 5 are provided for reading members of the scale 2 of names of days. At the said members of the scale there are arranged member 6 of a scale indicating digital calendar data, and a view slit 13 for reading members of a scale of a calendar code 3. In the left part of the cover there are provided view slits 7 for reading actual code digits 10 indicating the names of the first days of months. At the view slits 7 there are arranged members 8 of a scale of calendar months and a view slit 11 for reading the actual year 12. Code digits 10 and years 12 are formed on a sliding plate 9 which may be also designed to be taken off the main body 1.

A set of shelves 14 is shown in FIG. 3. Individual sections 15 of this set 14 are arranged at members of the scale of digital calendar data 6 and of the scale 2 of the names of days; this provides the possibility of an operative selection of informations on free cards according to calendar data.

FIGS. 4 and 5 show, respectively, two alternatives of the main arrangement of the device. In FIG. 4 the first carrier 16 comprises a scale of years; its numbers of members depends upon the chosen interval of years increased by a number of leapyears included in such interval. The first carrier 16 also comprises a scale 18 of the names of the first days of months which depends upon the cyclically repeating of the sequence of names and days (M, Tu, W, Th, F, Sa, Su); its number of members is 33, increased by a number of members of a scale 17. A carrier 19 is provided with a scale 20 of calendar months, which is arranged in the range of 35 orientation divisions of the same dimension as in the scale 17 and 19. On the scale 20 there are provided individual members in locations corresponding to the name of the first day of every month for a leap year and beginning by a day which is disposed in the auxiliary scale 18 at the member corresponding with the first month of the year. This means that for the Gregorian calendar system employed the first member is on the first division, the second member is on the fourth division, the third member is on the eleventh division, the fourth member is on the fourteenth division, the fifth member is on the sixteenth division, the sixth member is on the nineteenth division, the seventh member is on the twenty-first division, the eight member is on the twenty-fourth division, the ninth member is on the twenty-seventh division, the tenth member is on the twenty-ninth division, the eleventh member is on the thirty-second division, and the twelfth member is on the thirty-fourth orientation division. The carrier 19 then comprises a member 21 which may be represented by a mark, a stop, or an electrical contact, which serves for adjusting a pair of carriers 16 and 19 in the desired position. For the reading of desired data, there may be alternatively arranged view slits 22 or 23.

If desired, the carrier 19 may also be provided with a scale 24 of calendar months, corresponding with another calendar system. In the embodiment shown in FIG. 4 there is a scale S on carrier 19 for a world calendar system.

In the embodiment of FIG. 5 there is a carrier 25 which comprises a scale 26 of a digital marking of calendar data, corresponding with the maximum number of days in a month, i.e. 1–31, inclusive, in a system of 35 orientation divisions; the carrier 25 also comprises an orientation member 27. A carrier 28 carries a scale 29 of names of days which is formed by a cyclical repeating of a sequence of names of days (M, Tu, W, Th, F, S, Su), its number of members is 37. The carrier 28 also carries an auxiliary scale 30 of a calendar code having seven members. For a reading of the adjusted member there may be provided, as an alternative to the orientation members, a view slit 31 or 32. Sliding indicators 33 and 34 may be arranged on the apparatus for a comlex orientation in adjusted calendar data.

In FIG. 6 there is shown an alternative arrangement of a pair of carriers 35, 36, wherein the members of a scale 37 of calendar months are arranged at mutually regular distances; this distance depends on the number of members of a scale 38 of years (this arrangement is applied for the example in FIG. 1 with a distance of two divisions). The embodiment shown in FIG. 6 is an arrangement of a scale for three years. In this case, the auxiliary scale 39 of names of the first days of months is not formed by a sequence of names of days, but is formed in locations of marking of months of the desired year by a regular sequence of members determined by a rectangular sequence of a cyclically repeated names of days, as shown in FIG. 8*a*. In this case it is not necessary that on the scale 38 of years there be two members for each year, because there need be only one (in this example there appears the year 1976); this increases the exactness of reading the desired data. A view slit 41, or 42, may be made for reading instead of an orientation member 40.

A rectangular system of sequences of cyclically repeated names of days for a determination of members of the auxiliary scale of names of the first days of months is shown in FIG. 8*a*, wherein there is shown a section of a rectangular sequence for a range of years 1978–1984. The sequence of names of days in the horizontal direction is in a range of 35 orientation divisions. In these divisions there is also drawn in a parallel manner a scale 43 of calendar months in distances defined on the scale 40 in FIG. 4. The sequence of names of days is cyclically repeated in a vertical direction in the range of the desired interval of years; but two lines of a sequence correspond with each leap year. In the upper part there is drawn the rectangular sequence of names of days as marked by letters. A correct time orientation of names of the first day of the respective year, marked in the column 44 of years (FIG. 8*a*) is defined so that in a leap century (1901–2000) each leap year the last two digits of which may be divided by seven begins on a Sunday. Other leap years always begin on the day which may be characterized by a value of the remainder from the nearest or multiple of seven up to the last two digits of the respective leap year. In FIG. 8*a* there is indicated, e.g. the leap year 1980. Such year begins on Tuesday, which is characterized by a remainder from the nearest lower multiple of seven (i.e. 77) up to the last two digits of the year (i.e. 80) (i.e. 3). If one marks under the member 1 of the scale 43 the thus-found remainders from the complete multiples of seven, one obtains a time orientation of a rectangular sequence in digital marking of the characteristic digits, the section of which is marked on FIG. 8*b*. These characteristic code numbers for names of days make a calendar code, which is shown in FIG. 8*d*, and it has a deeper meaning for expressing internal relations of the respective calendar system. It may be taken as a rule that Monday corresponds with the remainder 5, Tuesday corresponds with the remaining 3, Wednesday corresponds with the remainder 1, Thursday corresponds with the remainder 6, Friday corresponds with the remainder 4, Saturday corresponds with the remainder 2, and Sunday corresponds with the remainder 0. This calendar code makes possible a digital assertainment of calendar data in the range of the whole calendar system.

Alternatively, it is possible to determine a calendar code as a climbing digital row in accordance with a row of names of days, as shown in FIG. 8*e*. In FIG. 8*c* there is arranged a rectangular sequence according to a calendar code defined in the said way. This calendar code supplies advantages for some arrangements of evaluation scales of apparatuses in accordance with the invention (e.g. the apparatus of FIG. 1). Alternatively, it is possible to apply a digital row 4, 1, 5, 2, 6, 3, 0 as a calendar code.

It is also possible to express on auxiliary scale 30 by a calendar code, as is shown in FIG. 5 with an application of a code shown in FIG. 8*d*. Members of the auxiliary scale of names of the first days of months for the desired year are in columns according to members of the scale 43 of calendar months in FIG. 8*a* on the horizontal line corresponding with the requested year. For a leap year the names of the first days starting the third month are located in respective columns on the next line of the rectangular sequence of names of days, for an ordinary year all members of the auxiliary scale of names of days (the first days of months) are always in a single line. Members of the auxiliary scale of names of days, valid for the desired year, are placed in circles to make them more readily recognized. The identity of the digital marking of names of days according to the calendar code enables an auxiliary scale 39 in FIG. 6 and also scales 18 and 30 to be replaced by digital scales 45, or 46 (there is a code according to FIG. 8*d* applied as an example). In FIG. 6 there is alternatively shown a scale 47 of names of the first days of months, which is valid for a system of World calendar.

Figure 7:
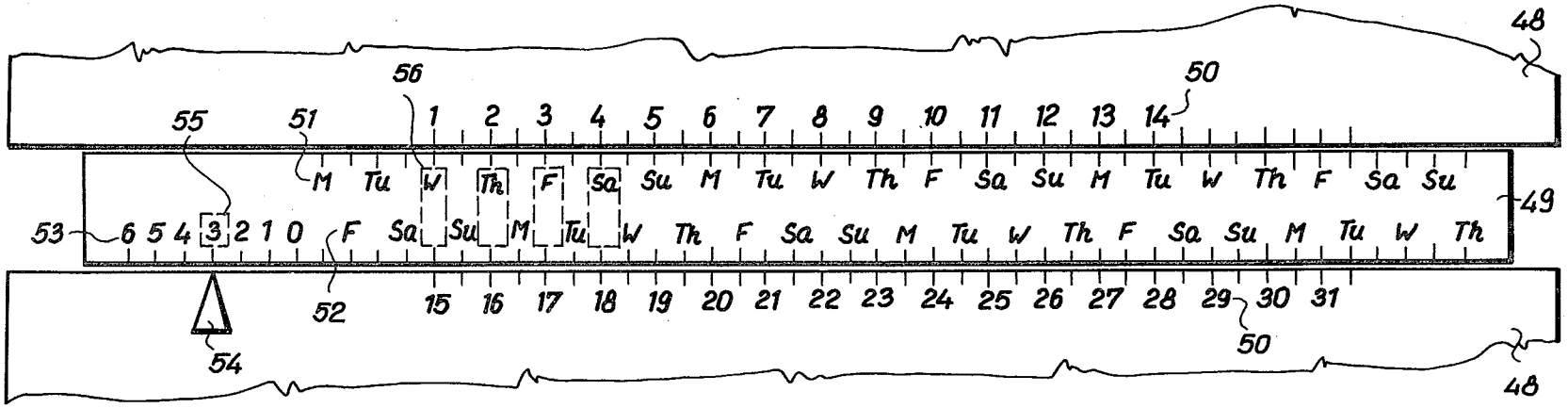
FIG. 7 is a view in plan of an arrangement which is an alternative of that shown in FIG. 5 as to the carriers of scales for a digital marking days, of an auxiliary scale of a calendar code and of a scale of a cyclically repeating of names of days, the scale of digital calendar data being divided into two parts.
Figure 4:
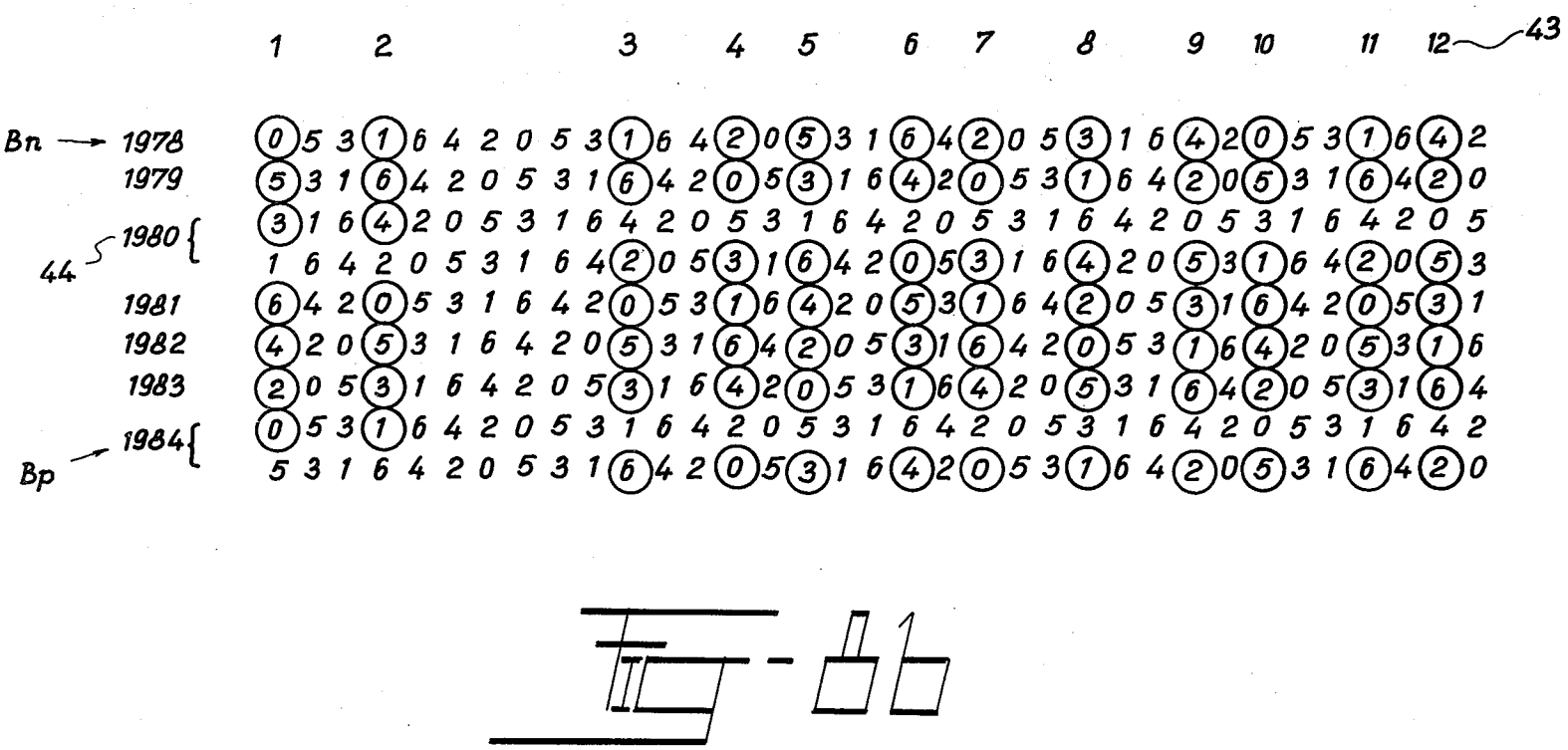

An alternative arrangement of scales of a second pair of carriers 48 and 49 is shown in FIG. 7. A scale 50 of the digital marking of calendar data is divided in two parts (1 to 4) and (15 to 31). In this case the members of the scale 50 are located at every second orientation division, as shown in FIG. 7. Analogously, members of a scale 51 of names of days are marked at every second division. The carrier 49 also carries the second scale 52 of names of days, which is, with respect to the scale 51, shifted through 7 divisions. Auxiliary scale 53 of a calendar code is marked in this case in a distance of individual members always through one division; a calendar code (according to FIG. 8*b*) is marked in a digital sequence which is different from that in FIG. 5, in which it is marked as a sequence of names of days. The arrangement of FIG. 8*d* is employed in the embodiment shown in FIG. 10. On the carrier 48 there is an orientation member 54, which may be represented alternatively by a stop, an electric contact, or in any other way. View slits 45 or 46 may be employed for a clearer adjustment, or for the reading of calendar data.

Code numbers K of actual months (circled on FIG. 8*b*) may be expressed as a sum of code digits A of years (in FIG. 8*b* in circled digits at individual years in the first column) and of code digit B of months ($B_p$ for leap years and $B_n$ for ordinary years), beginning on Sunday, e.g. in FIG. 8*b* at the years 1984 and 1978. This is useful especially for expressing code digits K of actual months in the wider range of years. An example of such an expression is shown in FIG. 9, wherein excess complementary digits for centuries are marked; FIG. 9 does permit a quick determination of a code digit of the desired month in the range of the whole calendar system. In FIG. 9 there are also marked code digits of months for a system of the World calendar permitting a parallel expression in this system. FIG. 9 shows code digits C for individual centuries. In the mathematical expression for K there is a common number a included, which can reach values 0, 1, 2, while at the same time the term $0 \leqq K \leqq 6$, must be fulfilled.

In FIGS. 10 and 11 there is shown an embodiment of an apparatus according to the invention using linear scales which are an alternative to those shown in FIGS. 6 and 7. The apparatus of FIGS. 10 and 11 consist of a solid base plate 57, on the upper surface of which members of a scale 58 of names of days and members 59 of a calendar code are marked. The base plate is provided on its longitudinal edges with guide grooves for a cover 60, which at the right is provided with members 61 of a scale of a digital marking of calendar data, the cover being provided with view slits 62 for reading the respective members of the scale of names of days. In the left part of the cover there is disposed a sheath 62 on the outer surface of which there is a scale 64 of names of calendar months, at the members of which there are provided view slits 65 and 66 for reading members of an auxiliary scale 67 of the first day of month (code marking of actual months), or a scale 68 indicating a total number of days of individual months. The scales 67 and 68 are provided on a plate 69, which is slidable in the sheath 63 and is exchangeable.

In the lower part of the sheath 63 there is slidably mounted therein an indicator 72 for making the set-up month more evident and clearer. Under the sheath 63 in the cover 60 a view slit 73 is provided for reading the adjusted member on the auxiliary scale 59 of the calendar code. A screen 74 for screening excess days over the actual number of days of the adjusted month is slidably mounted on the cover 60. Sliding pointers 75 and 76 for marking the respective day are mounted on the cover 60. The arrangement of the scale 67 and view slits 65 or 66 is marked in FIG. 10 step-by-step one below the other and makes it possible to multiply data of the plate 69. In addition, a scale 71 of years is provided on the plate 69, the members of such scale being read in a view slit 70.

The apparatus according to FIG. 1 may be employed as well.

Assume that one wishes to ascertain the date of the week on which June 20, 1978 fell. The plate 9 is shifted to a position in which 1978 is seen in the view slit 11. Then at the member of the scale 8 indicating June there will be read the code marking of June, 1978, in the view slit 7. One then shifts the cover 4 until the digit 6 on the scale of the calendar code is seen in the view slit 13, since the digit 6 was read in the view slit 7. Thus, the calendar of the month June, 1978 is now set up. On it may be read the fact that June 20, 1978 was a Tuesday.

The apparatus according to FIGS. 10 and 11 is adjusted in the same manner. Thus, the pointer 72 is shifted to the desired month of the actual month, and the sliding pointer 76 is shifted to the desired or actual date. Then one may set up the screen 74 in the position in which the visible number of days of the months corresponds with the digit which is seen in view slit 66 at the desired (adjusted) month.

If one wishes to determine, by use of the basic arrangement of FIGS. 4 and 5, the day of the week on which Aug. 11, 1973 fell, the first two carriers 16 and 19 are adjusted to such actual position that the orientation member 21 indicates the year 1973. On the auxiliary scale 18 one reads at the member 20 of the scale indicating August, i.e. 8, that August begins on Wednesday, or 1 on the scale of 46. The other two carriers 25 and 28 are set up in such a mutual position that the orientation member 27 indicates the marking of Wednesday on the auxiliary scale 30 of the calendar code, or 1 on the scale 47 (according to the calendar code shown in FIG. 8*d*). In this manner on the scales of the carriers 25 and 28 there is adjusted a calendar of August, 1973, upon which it may be read that Aug. 11, 1973 was a Saturday.

One proceeds analogously when applying the scale for another calendar system. By means of a mutual coupling of calendar data according to various calendar systems, one may secure an evaluation of calendar data either individually for each calendar system, or one may determine the difference of data according to both systems. This is why the apparatus of the invention may be called a universal one.

Although the invention is illustrated and described with reference to one preferred embodiment thereof, it is to be expressly understood that it is in no way limited to the disclosure of such preferred embodiment, but is capable of numerous modifications within the scope of the appended claims.

What is claimed is:

1. A universal apparatus for evaluating calendar data comprising two relatively slidable, linearly arranged members, the first member being a main body provided on the reading surface with a scale of names of days and with a scale of seven members of a calendar code, and the second movable member is provided both with view slits at which there are members of a scale of digital calendar data, and with a view slit for the calendar code, an indication mechanism for indicating actual months consisting of view slits, at which there are arranged members of a scale of calendar months, a view slit for reading the actual year, and a movable plate carrying code digits of actual months and a scale of years and being provided with members corresponding with other calendar systems, said calendar code includes the names of days M,Tu,W,Th,F,Sa,Su with a sequence of corresponding members of the calendar code 5,3,1,6,4,2,0.

2. An apparatus as in claim 1, wherein the indication mechanism for indicating actual months comprises a tabular arrangement for code digits of actual months on a reading surface of the second member as a system of code digits of first days of actual months in a desired range of years from a rectangular sequence of names of days marked by lettes or code digits, in a range of 35 divisions according to a sequence of calendar months on the first, fourth, eleventh, fourteenth, sixteenth, nineteenth, twenty-first, twenty-fourth, twenty-seventh, twenty-ninth, thirty-second, thirty-fourth place.

3. An apparatus as in claim 1, wherein the indication mechanism for indicating actual months comprises a tabular arrangement of code digit of actual months on a reading surface of the second member as a system of code digits of first days of actual months in a desired range of years from a rectangular sequence of names of days marked by code digits in a summary table of code digits for the whole range of the calendar system.

4. An apparatus as in claim 1, comprising a set of shelves, the section of which are arranged at the members of the scale of calendar data and a scale of names of days.

* * * * *